United States Patent [19]

Fougeres

[11] Patent Number: 4,978,025

[45] Date of Patent: Dec. 18, 1990

[54] STANDABLE BAG HAVING AN INTERNAL ARMATURE

[75] Inventor: Michel Fougeres, Briare, France

[73] Assignee: Alizol S.A., Briare, France

[21] Appl. No.: 433,295

[22] Filed: Nov. 8, 1989

[30] Foreign Application Priority Data

Nov. 9, 1988 [FR] France ..... 88 14650
Feb. 7, 1989 [FR] France ..... 89 01549
Apr. 6, 1989 [FR] France ..... 89 04555

[51] Int. Cl.[5] ..... B65D 30/22; B65D 33/02

[52] U.S. Cl. ..... 222/105; 222/173; 222/214

[58] Field of Search ..... 222/173, 105, 107, 214; 383/104, 119, 44; 493/213, 214, 215, 929, 931

[56] References Cited

U.S. PATENT DOCUMENTS 3,523,637 8/1970 Stec .
3,670,927 6/1972 Hubbard .
3,799,914 3/1974 Schmit .

FOREIGN PATENT DOCUMENTS 1120327 7/1956 France .
1182648 8/1960 France .
2076112 10/1971 France .
2171001 9/1973 France .
2436719 4/1980 France .
202857 8/1923 United Kingdom .
651638 4/1951 United Kingdom .
788012 12/1957 United Kingdom .
802292 10/1958 United Kingdom .
1048308 11/1966 United Kingdom .

*Primary Examiner*—Andres Kashnikow
*Assistant Examiner*—Philippe Derakshani
*Attorney, Agent, or Firm*—John R. Pegan

[57] ABSTRACT

The present invention relates to a bag made of sheets of heat weldable plastics assembled by welding lines along their edges, and comprising a base also made of a sheet of heat weldable plastics allowing the bag to be placed in an upright position. The bag further comprises an armature extending substantially from its base to its opposite upper edge, which armature comprises a vertical rod of length approximately equal to the height of the bag and two crosspieces, an upper crosspiece along the upper edge of the bag, and a lower crosspiece along the base of the bag.

23 Claims, 5 Drawing Sheets

STANDABLE BAG HAVING AN INTERNAL ARMATURE

FIELD OF THE INVENTION

The present invention relates to a standable bag, for containing liquid products, having an internal armature.

BACKGROUND OF THE INVENTION

More and more frequently, liquid or semi-liquid products are packaged in bags which are formed from one or several sheets of heat weldable plastics, the sheets being assembled by welding lines extending along their edges, so as to define in the bag a compartment for storing a liquid.

In some cases the bag is provided with a base, also made from a heat-weldable plastic sheet, which allows the bag to be placed in a generally upright position, at least temporarily.

In use, a corner of the bag is severed or cut to define an orifice through which the liquid can be poured.

The advantage of such bags is that, once empty, they can be easily disposed of inasmuch as they occupy a negligible volume, as compared to the volume occupied by rigid containers of equivalent content. Further, their destruction raises relatively less problems, both with respect to power consumption and to rejection of polluting compounds.

However, the side walls of the bag have a relatively low stiffness, which often results in the bag tilting over, and consequently spilling its contents.

Therefore, the sizes and volumes of such bags are kept relatively low and they can be used only once.

A typical example of a bag of this kind is disclosed in French Patent No. 2 436 719.

As taught in French Patent No. 1 120 327 to Rudolf EY, U.S. Pat. No. 3,523,637 TO F. J. STEC or British Patent No. 202 857 to E. J. HARBORD, the bag can be completed by an armature in order to improve its standability. In the EY bag, the armature is merely a stem extending generally centrally from the top to the base of the bag. The reinforcement of the bag is however limited, which restricts the applicability of this solution to low volume bags.

In the HARBORD bag, the armature is designed as a complete frame having rods along all the apices of the bag, some of the rods being foldable to collapse the frame when the bag is empty. This arrangement is rather complicated and practically applicable only to rectangular-shaped bags.

In the STEC bag, the armature is a relatively rigid one-piece member such as an I-beam, which is only applicable to rectangular-shaped bags and cannot be collapsed.

Other types of bags having armatures are shown in British Patent No. 802 292, U.S. Pat. No. 3,799,914, French Patent No. 2 076 112, French Patent of Addition 73 595, French Patent No. 2 171 001, U.S. Pat. No. 3,670,927, and British Patent Nos. 788 012, 651 638 and 1 048 308.

SUMMARY OF THE INVENTION

It is an object of the invention to provide a standable bag with an efficient armature allowing the manufacture of bags of higher volume, for example up to 5 (five) liters.

It is another object of the invention to provide a standable bag having an armature which can easily be collapsed when the bag is empty.

It is a further object to provide a standable bag with an inexpensive armature which is light and easy to manufacture.

According to the invention, these objects are attained by a bag made of sheets of heat weldable plastics, said sheets being assembled by welding lines along their edges, and the bag comprising a base also made out of a sheet of heat weldable plastics which allows the bag to be placed in upright position, wherein the bag further comprises an armature extending substantially from its base to an upper edge of the bag distant therefrom, and wherein said armature comprises two crosspieces, viz. an upper crosspiece along said upper edge of the bag and a lower crosspiece along said base of the bag.

Accordingly, owing to the armature, the bag has a higher stiffness and the risk of tilting is greatly reduced.

According to an improved feature of the invention, the armature comprises a tubular piece going through the wall of the bag in sealing manner, and a cap for closing said tubular piece. Such improvement provides a pouring spout for the liquid.

And advantageously, the bag can be provided with a dosage compartment. Indeed, certain liquids are sold in relatively large volumes and must be split into unit doses by the consumer. Most of the currently known devices are equipped with a dosing cap which is used alternately as a closure for the pouring orifice and as a container for dosing a predetermined volume of liquid.

In a variant of the invention, the bag comprises a main storage compartment situated at its lower part and a dosage compartment at its upper part, adjacent the main compartment and connected therewith by at least one passage, the armature extending through the main compartment and through the dosage compartment. Advantageously, the two compartments are divided by a welding line assembling the sheets which make up the bag, the passage being constituted by an interruption in the welding line.

Preferably, the passage between the main compartment and the dosage compartment comprises a non-return valve preventing the liquid from flowing from the second compartment into the first.

In a variant, the passage is constituted by a tubular piece joined to the armature and going through the welding line between the two compartments, and the non-return valve is constituted by a flexible flap cooperating with the orifice of the tubular piece.

In another variant, the armature comprises a part forming handle for holding the bag.

In yet another variant, the vertical armature is constituted by an elongate member folded over and extending from the base of the bag to its upper part.

It is then possible, according to this improvement, to produce armatures for bags made of sheets of plastics which extend over at least twice the height of the bag and near the walls thereof.

In different variants of the invention:

the elongate member is folded twice to form an armature having two vertical arms joined by a horizontal piece adjacent the base of the bag, after folding, the elongate member is joined, by its two ends, to an upper crosspiece placed close to the upper edge of the bag, after folding, the elongate member is joined, at folding level, to an upper crosspiece, placed near the upper edge of the bag, the two arms of the armature extend towards the base in points spaced apart in crosswise direction; and optionally, said arms end into portions folded close to the base of the bag;

the bag comprises two such armatures, or more, the elongate member has folding zones where the folding is achieved by reversible deformation, the elongate member has folding zones where the folding is achieved by irreversible deformation, the armature has at least one weakened zone, the armature has two parallel rods, joined together by connecting elements.

BRIEF DESCRIPTION OF THE DRAWINGS

The invention will be more readily understood on reading the following description with reference to the accompanying drawings in which.

COMPLETE DESCRIPTION OF THE INVENTION

Figure 1:
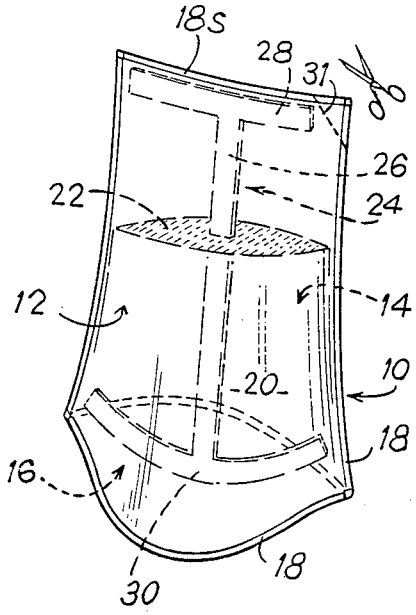
FIG. 1 is a lateral perspective of a bag according to the invention.

Referring now to the drawings, FIG. 1 shows a bag 10 composed of two lateral sheets 12, 14 or of one folded over sheet and a base 16 in heat weldable plastics, assembled along their edges by welding lines 18, in order to define an inner volume 20 containing a liquid 22.

The bag comprises an armature 24 in semi-rigid material, composed of a vertical central rod 26, of length approximately equal to the height of the bag, and two crosspieces: an upper crosspiece 28 which fits along the upper edge 18*c* of the bag, and a lower crosspiece 30 which fits along the base 16 of the bag and whose shape is adapted to the profile of said base for improved stability.

As a variant, the upper crosspiece is caught in the upper horizontal welding line.

A cutting line 31 is marked in one upper corner of the bag to define a pouring orifice for the liquid product 22 contained in the bag.

Figure 2:
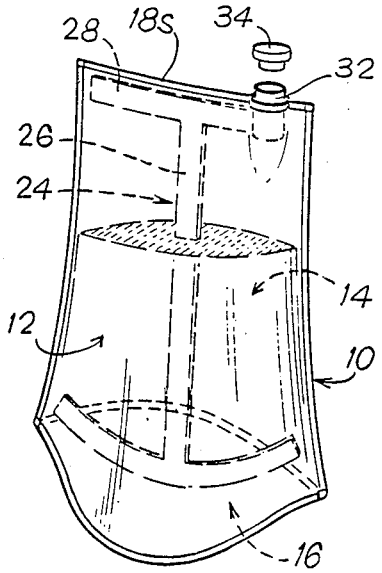
FIG. 2 is a similar view of a variant of the invention.

In the variant illustrated in FIG. 2, the upper crosspiece 28 comprises a piece of tube 32 traversing the wall of the bag, for example at the level of the upper welding line 18*s* of the bag, the two sheets 12, 14 being tightly fixed around the piece of tube 32, by welding, sealing or any other suitable method.

The piece of tube thus constitutes a pouring means for the liquid product contained in the bag. Tube 32 may of course be closed off by a cap 34.

Figure 3:
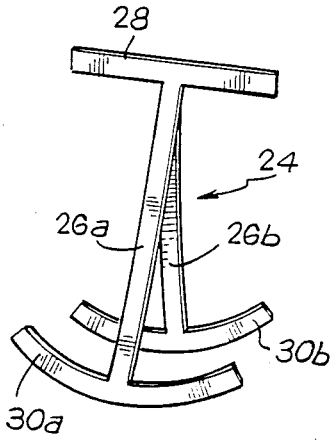
FIG. 3 illustrates another variant.

The variant armature 24 illustrated in FIG. 3 has only one upper crosspiece 28 and two diverging vertical stems 26*a*, 26*b*, each rod ending into a corresponding lower crosspiece 30*a*, 30*b*. Such armature is designed to improve the stability of the bag in upright position.

Then, when the bag is empty, it occupies no more room in the refuse bin than the previous one as the two vertical rods and the two lower crosspieces collapse one over the other.

Suitable materials for producing the armature are the readily incineratable plastics. It is particularly possible to use the same material as used for the sheets forming the walls and the base of the bag.

In a variant of FIG. 2, not shown, the vertical rod is constituted by a pouring tube.

Figure 4:
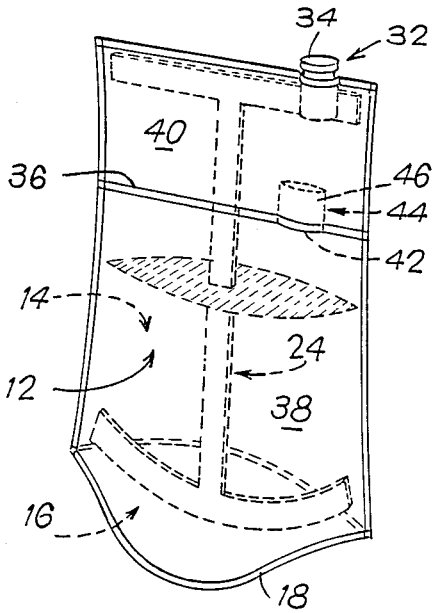
FIG. 4 illustrates a bag according to the invention having a dosage compartment.

According to an added characteristic illustrated in FIG. 4, the inner volume of the bag is divided by a substantially horizontal welding line into, at its lower part, a main storage compartment 38, and at its upper part, a dosage compartment 40, designed so as to be able to contain a predetermined volume of liquid corresponding to a unit dose of the liquid product.

To provide a passage 42 for the liquid contained in the main compartment 38 to flow through into the dosage compartment 40, the horizontal welding line 42 is interrupted in at least one part 42. The liquid is prevented to flow in the opposite direction by a non-return valve 44, associated to passage 32 as indicated below:

a short, tubular and flattened piece 46 made from a heat weldable plastics sheet is partly caught in the welding line 36 and extends entirely in the dosage compartment 40.

Figure 5:
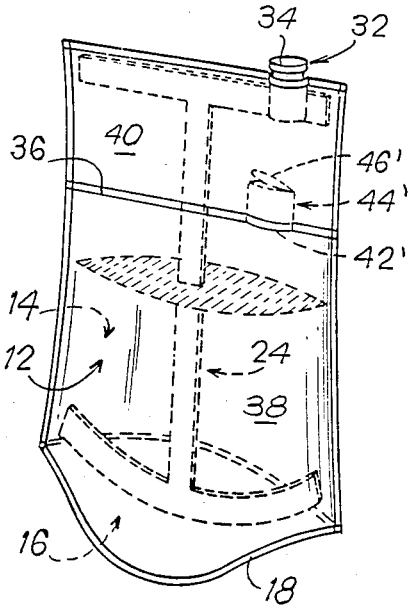
FIG. 5 illustrates a variant embodiment of the bag shown in FIG. 4.

In a variant illustrated in FIG. 5, the passage 42 between the two compartments is a tubular piece 42' fast with the armature 24 and traversing the welding line 36 separating the compartments 38, 40, and the non-return valve 44 is a flexible flap 46' which cooperate with the opening of the tubular piece 42' on the dosage compartment 40 side.

The apparatus is used as explained hereafter:

A dose of liquid product is caused to flow from the main storage compartment 38 into the dosage compartment 40 by hand-squeezing the container, thereby urging the liquid to flow through the passage 42.

The hand squeezing operation is discontinued when the dosage compartment is filled with liquid. The reverse flow of the dose of liquid then contained in the dosage compartment 40, into the main storage compartment 38 is prevented by the non-return valve 44. The pouring orifice 32 is then opened, and the dose of liquid contained in the dosage compartment can be poured out through orifice 32 by hand-squeezing the dosage compartment, after what orifice 32 is closed.

For subsequent uses, it will be sufficient to repeat the hand-squeezing operation on the main compartment 38 to transfer a new dose of the liquid product into the dosage compartment 40, the orifice 32 being of course closed throughout this operation and to pour out this new dose by opening said orifice and hand-squeezing the dosage compartment.

The above sequence of operations is repeated until no liquid is left in the main compartment.

Then the empty container can be disposed of, and because, when it is empty, it takes on a virtually flat shape of negligible volume, and takes very little room in any rubbish bin.

Its destruction by conventional incineration generally raises less problems than the destruction of similar rigid containers since it is possible to select among the heat weldable plastics, those which contain the least polluting compounds.

By "liquid product" in the foregoing, is meant any viscous or past-like material.

It is understood that if the invention is quite obviously applicable to liquid products usable for cleaning and maintenance purposes, it is also applicable, unrestrictively, to all types of liquids such as for example, liquid foods, industrial liquids, pharmaceutical or parapharmaceutical liquids.

Any distinctive, decorative or informatory markings can be affixed on the container, either by printing on sheets 12, 14, or by labels stuck on said sheets.

As a variant, the container may be enclosed in a box of semi-rigid material, such as in cardboard, which can receive the printed markings.

Finally, certain applications, such as with high viscosity products or paste-like products, do not require the use of the non-return valve. Indeed, the reverse flow of such products through the passage 42 will be limited by the actual viscosity of the product, when said product is expelled through the outlet orifice 32.

It is worth noting that the armature 24 extends through the two compartments 38, 40, which enables the dosage compartment to remain vertical above the main compartment in any circumstances, as the pouring orifice 32 remains at the top of the bag. Indeed, should the armature be reduced to the height of the main compartment 38 only, the dosage compartment 40 could tilt over and any product left in said compartment could then escape through orifice 32 if cap 34 had not been properly screwed on.

The invention therefore permits the production of high volume bags, up to 3 and even 5 liters, which are non-tiltable and are destined to be used gradually.

Figure 6:
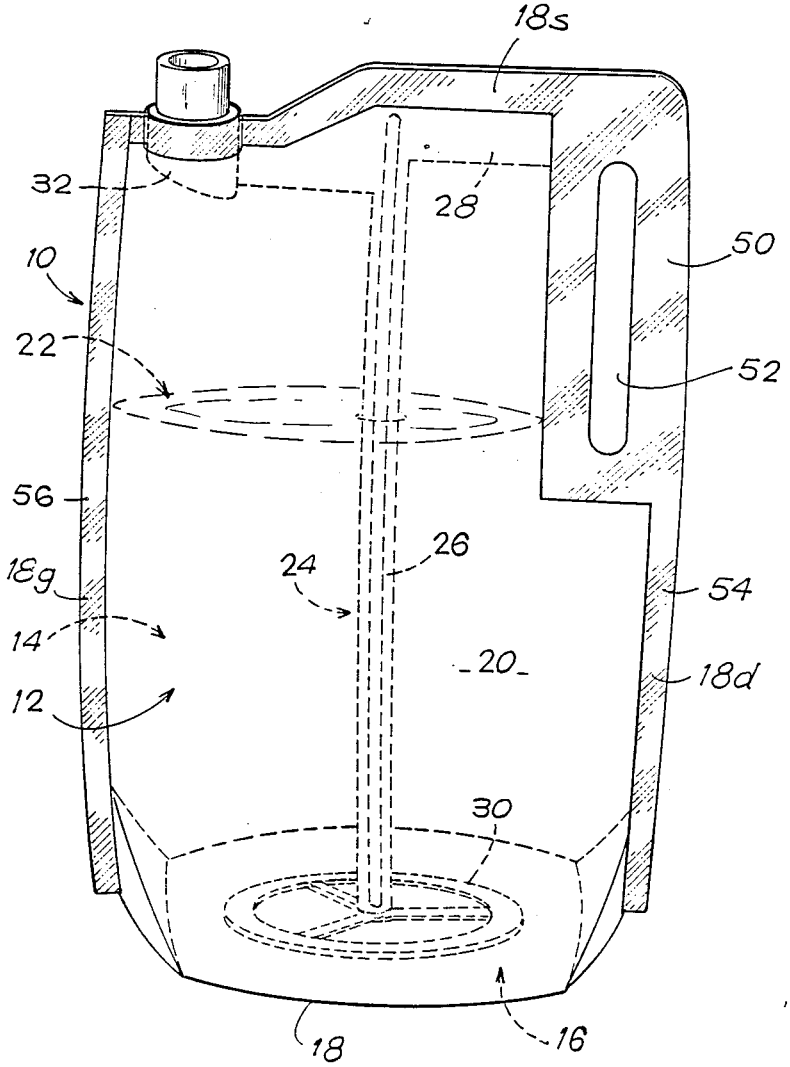
FIG. 6 is a lateral view of a bag provided with a handle.

Bag 10 illustrated in FIG. 6 is of the type illustrated in FIG. 2.

Its armature 24 comprises a vertical central rod 26, of length approximately equal to the height of the bag, and two crosspieces: an upper crosspiece 28 fitting against the upper border 18*s* of the bag, and a lower crosspiece 30 fitting against the base 16 of the bag and having a shape adapted to the profile of said base.

On the side opposite to the pouring tube 32, the upper crosspiece 28 comprises a substantially vertical plate 50, provided with an oblong opening 52, and sandwiched between the two sheets 12, 14 welded thereto.

Plate 50, which constitutes part of the armature, thus forms a handle for a user to hold the bag 10 with by passing his fingers through said opening 52.

Understandably, this improvement is applicable to all the embodiments and variants illustrated and described in the present description.

Moreover, the part of the armature forming the handle can be situated elsewhere, such as for example above the upper crosspiece 28, and it can have a different shape, such as that of an approximately circular ring, or a hook.

And advantageously, plate 50 which forms the handle, can be extended at its lower end by a strip 54, caught in the lateral welding line 18*d* and extending as far as the bottom 16, in order to constitute a stabilizing stand for the bag. Complementarily, a second strip 56 can be caught in the welding line 18*g* of the opposite side, through all or part of the height of the bag 10, in order to form a second stabilizing stand for the bag.

Advantageously if said second strip extends through the whole height of the bag, said strip will be fast with the upper crosspiece 28.

Figure 7:
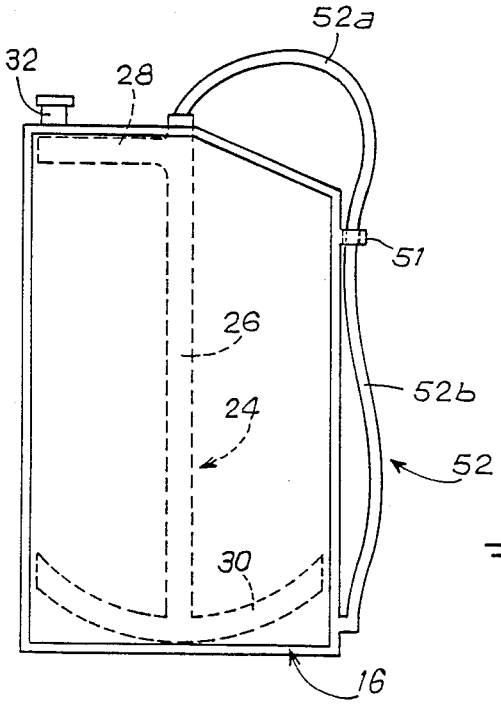
FIG. 7 is a variant of FIG. 6.

In the embodiment illustrated in FIG. 7, handle 52 is a strap of which one end is fixed to the upper part of the armature, for example where the vertical part 26 joins up with the upper crosspiece 28, the other end being fixed to the bag near to its base.

The strap passes through a loop 51 fixed along one edge of the bag close to the top. The strap has then two portions 52*a*, 52*b*, one 52*a* situated between the upper joining point of the strap and the loop 51 and enabling the bag to be held upright, and the other 52*b* situated between the loop 51 and the base 16 and enabling the bag to be held in inclined or horizontal pouring position.

Figure 8:
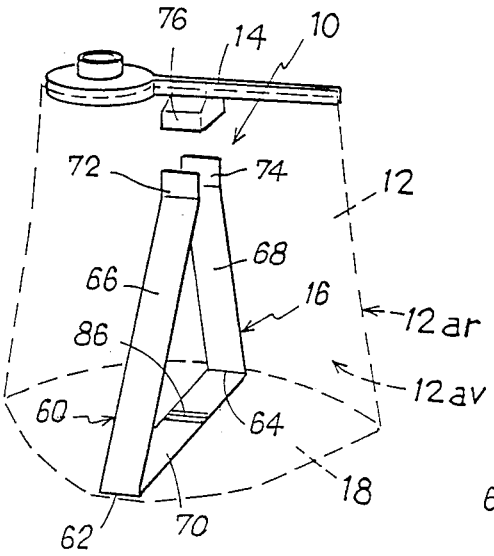
FIG. 8 illustrates a bag having a folded over, elongate armature.
Figure 9A:
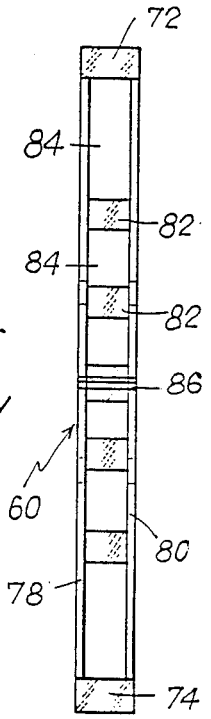
FIGS. 9*a* and 9*b* are, respectively, front and side views of the member constituting the armature according to the embodiment illustrated in FIG. 8, and FIGS. 10 through 15 illustrate variants of such an armature.
Figure 9B:
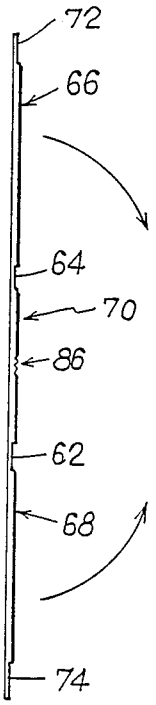

The armature illustrated in FIG. 8 is constituted, for ready production and assembly purposes, of an elongate member 60 illustrated in FIGS. 9*a* and 9*b*, folded in two zones 62 and 64 in order to have two vertical arms 66 and 68 on either side of an intermediate horizontal piece 70 extending along the base 18 of the bag, substantially from the front wall 12*av* of the bag to its back wall 12*ar*.

The two upper ends of the arms 66 and 68 are joined to the upper crosspiece 14 by any appropriate means such as welding, sealing, pressure-locking, or similar.

In particular, and as illustrated, the arms 66 and 68 can end into flattened tabs 72, 74 inserted together by force into a housing 76 provided in the upper crosspiece 14.

And as further illustrated in FIGS. 9*a* and 9*b*, the piece 60 may be formed of two parallel strips 78, 80 joined at intervals by joining elements 82 separated by windows 84. The folding zones 62, 64 can be defined by thinner portions of the strips 78, 80 and if necessary of the joining elements 82, in order to provide a "reversible" folding, i.e. involving a plastic deformation of the material.

According to a variant, not shown, the folding zones are not material, except for the possible provision of visual and/or tactile marks and the folding is irreversible, i.e. involving a plastic or permanent deformation of the material.

One fact to be noted is that the armature obtained according to the invention is a double vertical armature 16, of which the two arms 66, 68 spread along the front 12*av* and back 12*ar* walls of the bag 12 while keeping said walls in extended conditions, thereby preventing the bag from collapsing and subsequently spilling its contents. The horizontal piece 70 further keeps the base 18 of the bag in rigid condition thus ensuring good base support thereof.

Suitable materials usable for producing the armature are plastics, and in particular injectable plastics.

The following figures illustrates a number of variants of the invention.

Figure 14:
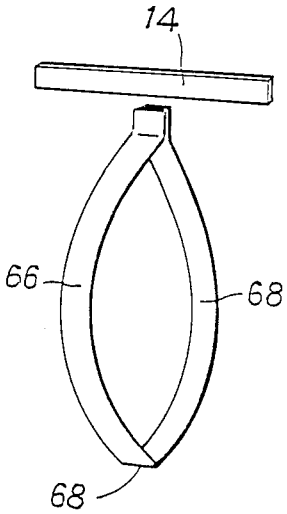

In FIG. 14, the armature only has one fold 63 situated close to the base of the bag and from which the two arms extend up to the upper crosspiece while taking on an arched form.

In this particular case, the arms extend along the front and back walls of the bag only over about their upper half. This variant is suitable for producing small volume bags.

Figure 15:
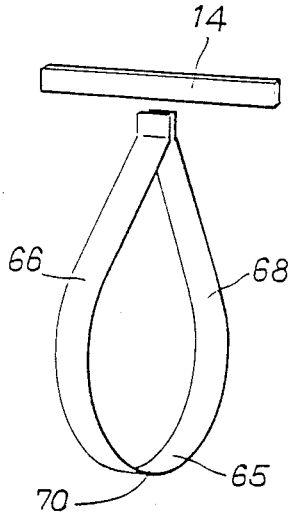

In FIG. 15, the armature is bent over to form a loop 65. The lower part 70 of the loop extends at least partly along the base of the bag, and the lateral parts of the loop constitute the arms 66 and 68 of the armature which extend at least in parts, along the front and back walls of the bag.

Figure 11:
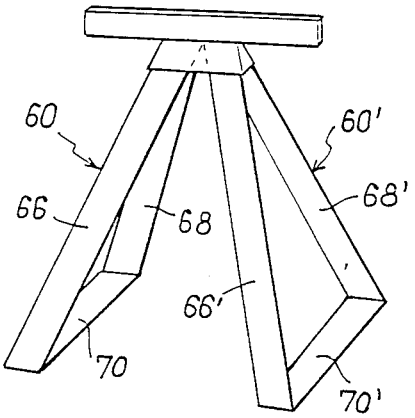

The armature illustrated in FIG. 11 is double, meaning that it is formed of two individual armatures 60, 60' of the type of those illustrated in FIGS. 8, 14 or 15, and so arranged that their arms 66, 68 and 66', 68' reach the base in two transversely spaced zones, the two horizontal pieces 70, 70' spreading along the base of the bag in said zones in order to improve its support in upright condition.

This variant will be advantageously applicable to large volume bags having a flat base of a certain surface.

Figure 12:
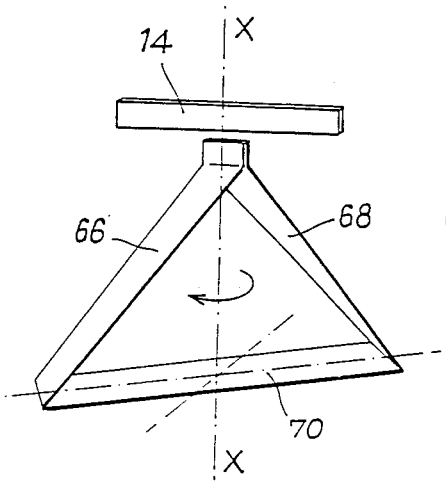
Figure 13:
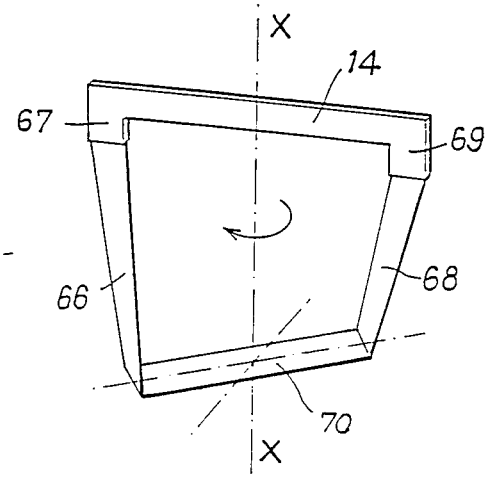

In FIG. 12, the armature 60 is of the type of that shown in FIG. 1, but its two arms have reverse inclinations with respect to the vertical, so that the horizontal piece 70 extends substantially diagonally with respect to the base of the bag.

This can be achieved by making said horizontal piece 70 longer than the width of the base and by twisting slightly the armature assembly around the vertical median axis XX, this twisting action causing or not a permanent deformation of the armature. Once introduced into the bag, the armature retains this shape due to the fact that the length of the horizontal piece exceeds the width of the base.

FIG. 12 shows an armature of which the two arms 66, 68 are joined to the upper crosspiece in two spaced apart points 67, 69.

The lower horizontal piece 70 of the armature can be directed either widthwise with respect to the base, or diagonally as illustrated. Hereagain, the shape of the armature can be set by a slight twist around the vertical median axis XX.

Figure 10:
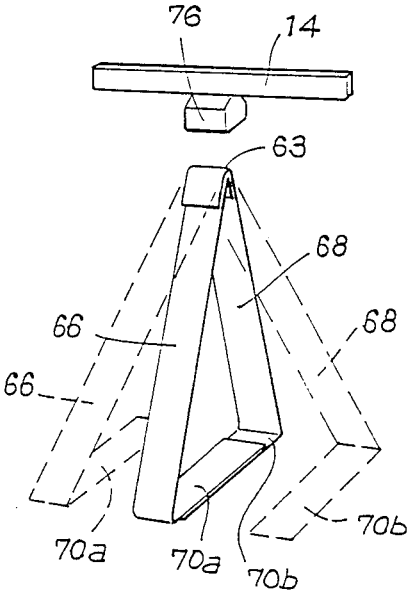

Finally, in FIG. 10, the fold 63 of the armature is situated at the upper end of the bag close to the upper crosspiece 14, and it is joined therewith by forced insertion into a housing 76. The two arms 66, 68 are extended by two pieces **70*a*, 70*b*** folded at an angle and spreading horizontally along the base of the bag, from one wall to the other or only over part of said base.

As a variant, and as shown in dotted lines in FIG. 10, the fold 63 can be slightly aslant, so that the arms 66, 68 have reverse inclinations with respect to the vertical and join up with the base of the bag in two transversely spaced points. The horizontal end pieces are then likewise transversely spaced and thus keeps the base rigid.

It is understood that anyone skilled in the art can device no end of variants from what has been described hereinabove, either by multiplying the number of armatures, or by changing the disposition of the folds of the bending zones of the elongate member constituting the armature, or even by changing the shape or the profile of the armature.

The invention also provides, particularly for those variants where the armature has a horizontal part which is adjacent the base of the bag, that the armature should comprise a weakened zone 86 as illustrated in FIGS. 8, **9*a* and 9*b*** along which the horizontal part can be either folded or broken in order to allow the "collapsing" of the bag when this is disposed of.

Finally, in all the embodiments described and illustrated hereinabove, it will be possible to place several vertical armatures between the lower crosspiece and the higher crosspiece in order to produce large volume bags.

What is claimed:

1. A bag made of sheets of heat weldable plastics assembled by welding lines along their edges, and comprising a base also made of a sheet of heat weldable plastics allowing the bag to be placed in an upright position, said bag further comprising an armature extending substantially from its base to its opposite upper edge, wherein said armature comprises a vertical rod of length approximately equal to the height of the bag and two crosspieces, an upper crosspiece along the upper edge of the bag, and a lower crosspiece along the base of the bag.

2. Bag as claimed in claim 1, wherein the armature comprises two vertical rods diverging from the upper crosspiece, each rod ending into a lower crosspiece.

3. Bag as claimed in claim 1, wherein the upper crosspiece comprises a piece of tube traversing the wall of the bag in sealed manner, and through which a liquid contained in the bag can be poured out, said piece of tube being closed off by a cap.

4. Bag as claimed in claim 1, wherein said long comprises a main storage compartment at its lower part, and a dosage compartment at its upper part, adjacent said main compartment and connected therewith by at least one passage, the dosage compartment being able to contain a dose of product of predetermined volume and comprising a pouring orifice, the passage between the two compartments being equipped with a non-return valve.

5. Bag as claimed in claim 4, wherein the main compartment and the dosage compartment are separated by a welding line having at least one interruption forming said passage.

6. Bag as claimed in claim 5, wherein said non-return valve is constituted by a flattened tubular piece made out of a sheet of plastics which extends from said welding line inside the dosage compartment.

7. Bag as claimed in claim 1, wherein the armature comprises a part forming handle for holding the bag.

8. Bag as claimed in claim 7, wherein said handle is fast with said upper crosspiece.

9. Bag as claimed in claim 8, wherein said handle consists in a plate which extends substantially vertically from one end of the upper crosspiece, said plate comprising an opening for the fingers of the user's hand.

10. Bag as claimed in claim 9, wherein said sheets are sandwich-welded on said plate.

11. Bag as claimed in claim 9, wherein said plate comprises a stand caught in a welding line of the bag and extending towards the base.

12. Bag as claimed in claim 1, wherein said armature is constituted by a folded-over elongate member which extends from the base of the bag to its upper part.

13. Bag as claimed in claim 12, wherein said elongate member is bent so as to form a loop of which the two ends join up at the top of the bag.

14. Bag as claimed in claim 12, wherein said elongate member has two folds defining between them a horizontal piece placed along the base of the bag, and above said folds, two arms extending up to the upper part of the bag.

15. Bag as claimed in claim 12, wherein the elongate member comprises a single fold situated near the base of the bag and two arms which extend from said fold to the top of the bag.

16. Bag as claimed in claim 12, wherein the elongate member comprises a single fold situated near the upper part of the bag and two arms which extend from said fold to the base of the bag.

17. Bag as claimed in claim 16, wherein said arms join with the base in points transversely spaced apart with respect to said base.

18. Bag as claimed in claim 16, wherein said arms end into horizontal folded-over pieces.

19. Bag as claimed in claim 13, wherein the two ends of the armature join up with the upper part of the bag in transversely spaced-apart points.

20. Bag as claimed in claim 12, wherein said armature presents folding zones where it can be folded by reversible deformation.

21. Bag as claimed in claim 12, wherein said armature presents folding zones where it can be folded by irreversible deformation.

22. Bag as claimed in claim 12, wherein said armature presents at least one weakened zone.

23. Bag as claimed in claim 12, wherein said bag comprises at least two armatures.

* * * * *